US005711283A

United States Patent [19]

Trigger

[11] Patent Number: 5,711,283

[45] **Date of Patent: *Jan. 27, 1998**

[54] SYSTEM FOR COMBUSTING FUEL

[75] Inventor: Vernon A. Trigger, deceased, late of Palms, Mich., by Vera W. Trigger, legal representative

[73] Assignees: Jerry B. Morof, Bloomfield; Angelo Lotti, Beverly Hills; Vera W. Trigger, Palms, all of Mich.

[ * ] Notice: The term of this patent shall not extend beyond the expiration date of Pat. No. 5,423,306.

[21] Appl. No.: 608,715

[22] Filed: Feb. 29, 1996

Related U.S. Application Data

[62] Division of Ser. No. 476,619, Jun. 7, 1995, Pat. No. 5,503,133, which is a division of Ser. No. 141,235, Oct. 22, 1993, Pat. No. 5,423,306.

[51] Int. Cl.[6] ..... F02P 15/68

[52] U.S. Cl. ..... 123/637

[58] Field of Search ..... 123/637, 536, 123/538; 422/186.04

[56] References Cited

U.S. PATENT DOCUMENTS

| | | | |
|---|---|---|---|
| 4,561,406 | 12/1985 | Ward | 123/536 |
| 4,582,475 | 4/1986 | Hoppie | 123/536 |
| 4,594,969 | 6/1986 | Przybylski | 123/536 |
| 5,044,347 | 9/1991 | Ulrich et al. | 123/538 |
| 5,061,462 | 10/1991 | Suzuki | 422/186.04 |
| 5,101,869 | 4/1992 | Lee | 123/536 |
| 5,423,306 | 6/1995 | Trigger et al. | 123/637 |
| 5,503,133 | 4/1996 | Trigger | 123/637 |

*Primary Examiner*—Raymond A. Nelli

*Attorney, Agent, or Firm*—Harness, Dickey & Pierce, P.L.C.

[57] ABSTRACT

An internal combustion engine system including an engine, timer/distributor device and a compliant electromagnetic device is disclosed. The engine may have one or more cylinders and includes an anode positioned above a cathodic piston whereby the anode delivers high intense short bursts of electrical energy through the combustion chamber and ignites fuel delivered by an injector. Each engine cylinder is connected to a distributor which sequences and delivers the high energy impulses from the compliant electromagnetic device to an individual cylinder when the piston is at or near top dead center. The compliant electromagnetic device includes an inductor, a power source and a field of material, i.e., the air/fuel mixture within the combustion chamber. The summed equivalence of the electromagnetic fields within the combustion chamber at any instant in time controls the intensity of the pulses and the quantity of pulses that are discharged by the anode. An alternative embodiment is provided which further improves performance by recirculating non-combusted gases and mixing them with high pressurized fuel and delivering the mixture to the combustion chamber where the fuel is fragmented, dissociated and combusted. The resulting internal combustion engine system has improved working efficiencies as well as a reduction in the emissions by the engine.

20 Claims, 7 Drawing Sheets

FIG 3
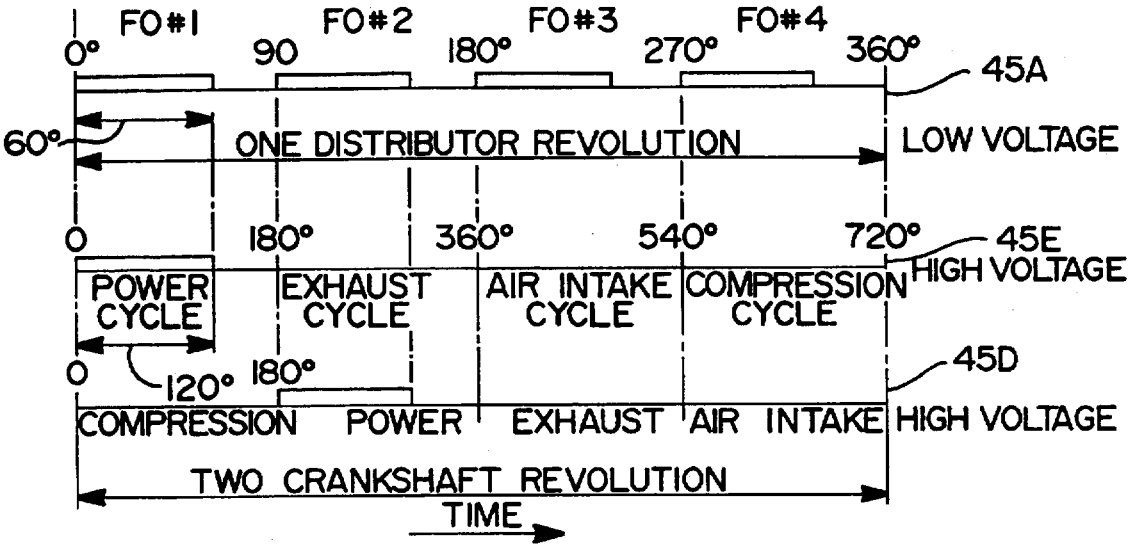
FIG 4
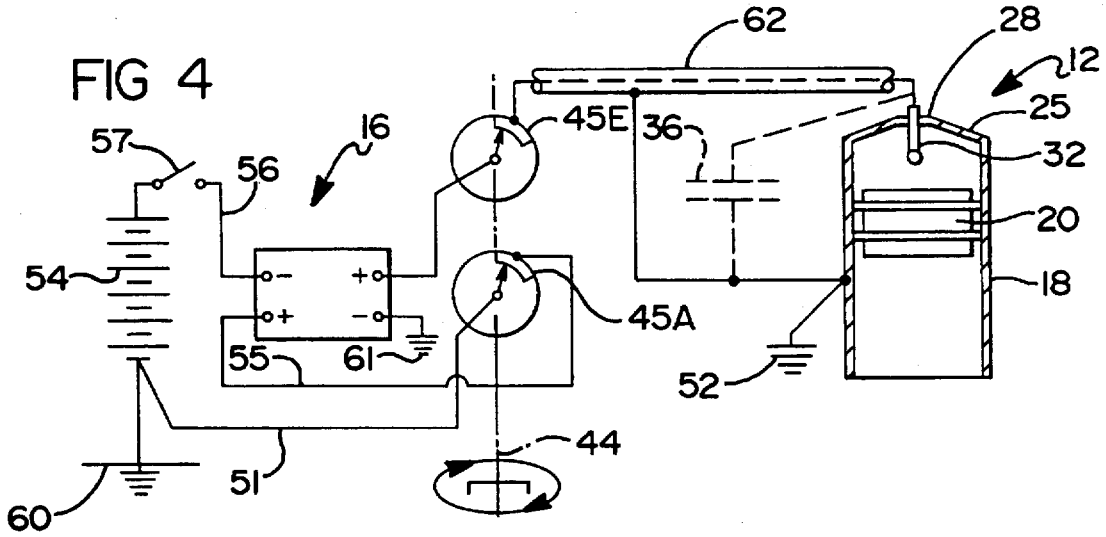
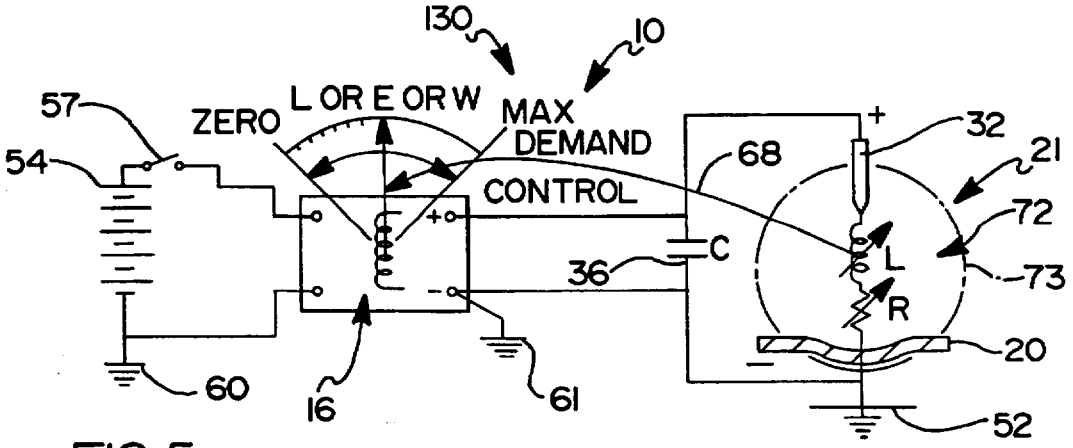
FIG 5

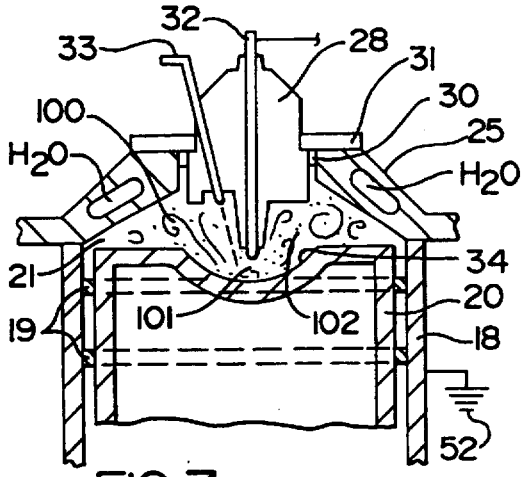
FIG 7
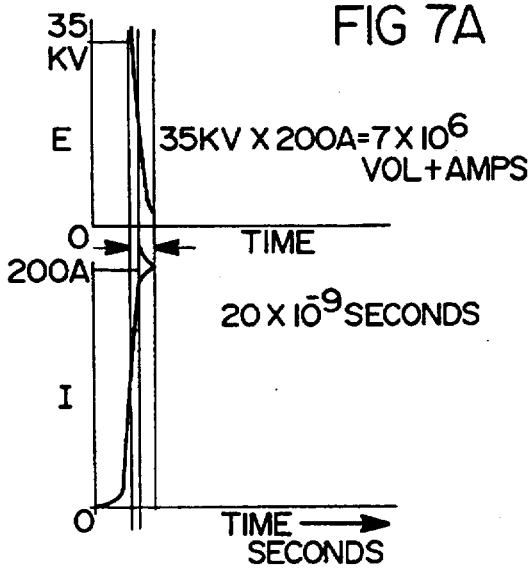
FIG 7A
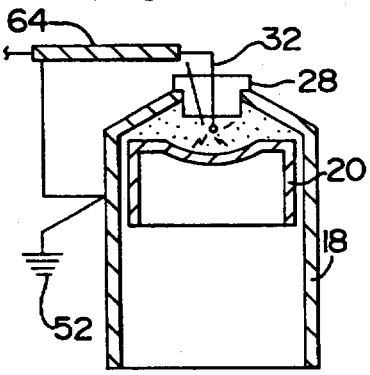
FIG 8
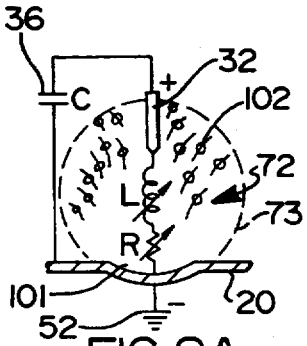
FIG 8A
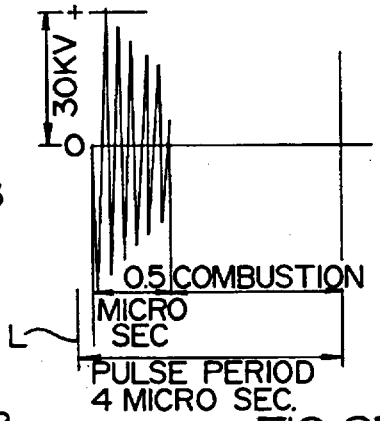
FIG 8B
FIG 9
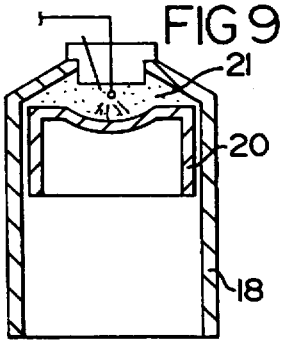
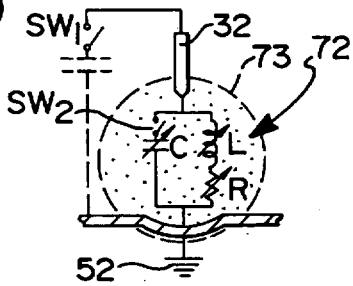
FIG 9A
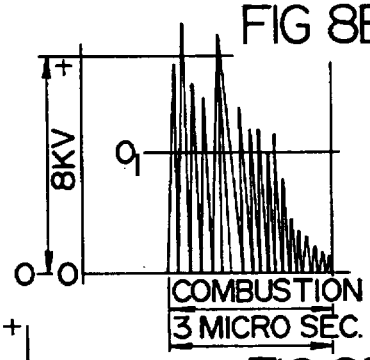
FIG 9B
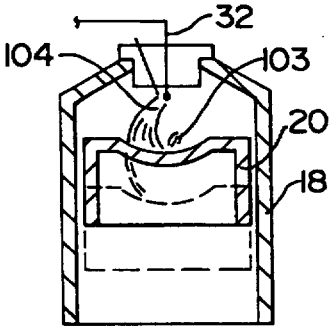
FIG 10
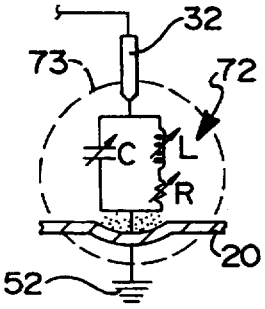
FIG 10A
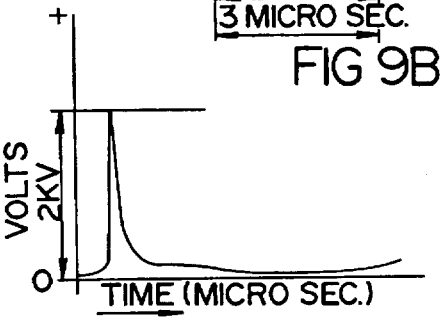
FIG 10B FIG 12
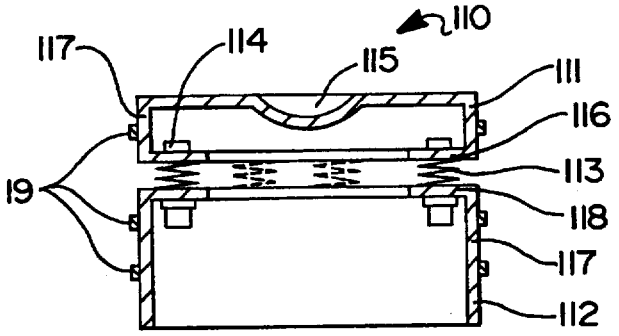
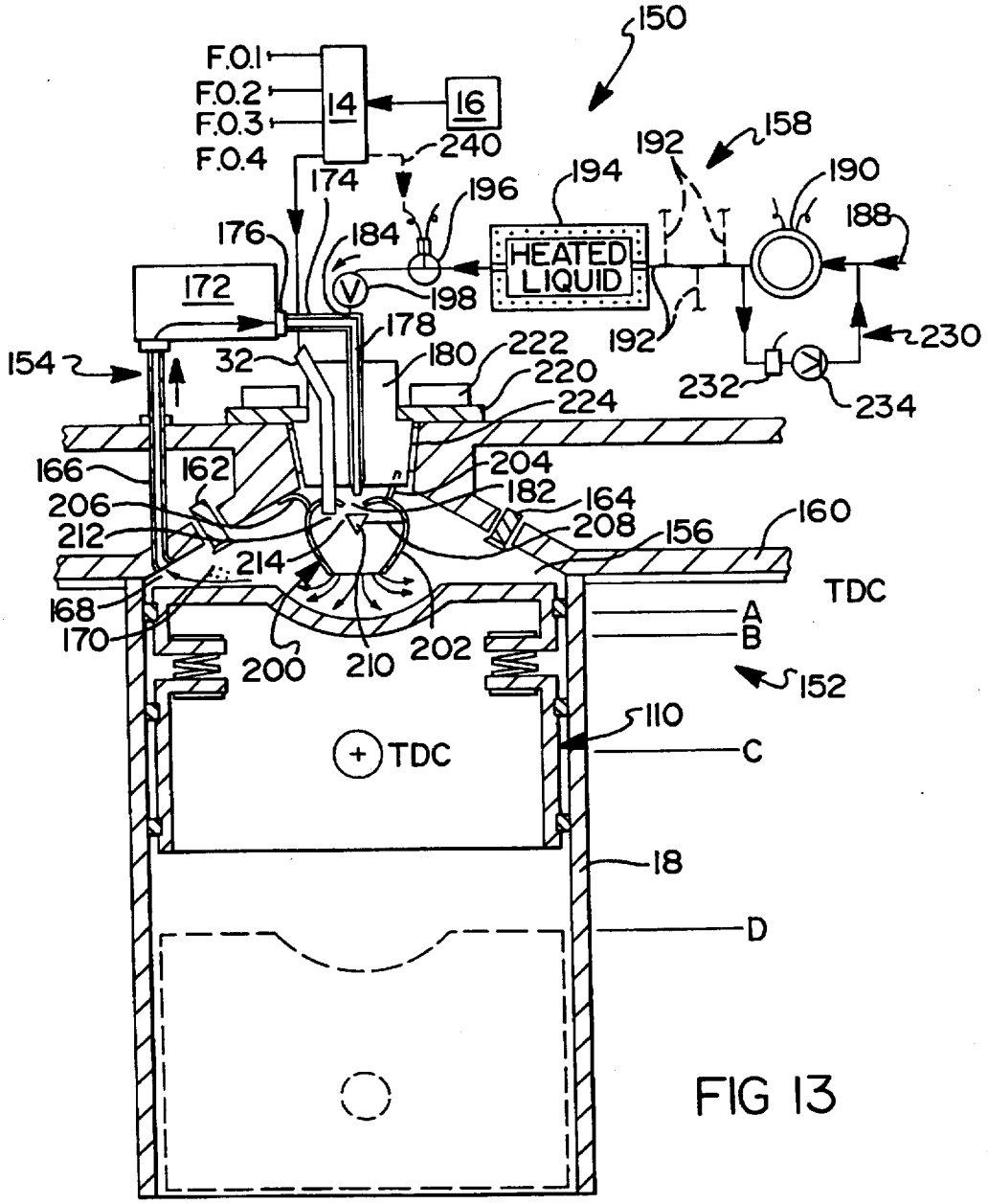
FIG 13

SYSTEM FOR COMBUSTING FUEL

CROSS-REFERENCE TO RELATED APPLICATIONS

This is division of United States patent application Ser. No. 08/476,619, filed Jun. 7, 1995, now U.S. Pat. No. 5,503,133 which is a division of Ser. No. 08/141,235, filed Oct. 22, 1993, now U.S. Pat. No. 5,423,306 issued Jun. 13, 1995.

FIELD OF THE INVENTION

The present invention relates generally to an internal combustion engine, more specifically, an improved internal combustion engine that uses a unique ignition system and a method for igniting fuel in an internal combustion engine so that mechanical efficiencies are increased and the overall emissions are substantially reduced or eliminated entirely.

BACKGROUND OF THE INVENTION

In a conventional gasoline internal combustion engine, after the fuel/air mixture is compressed by the piston, a single heat-producing spark is fired by the spark-plug in order to ignite the air/fuel mixture thus causing gas expansion, which results in driving the piston during the power stroke. The burning of the fuel, which commences at the spark and spreads throughout the combustion chamber of the cylinder, is relatively slow and inefficient which results in unburned or only partially-burned fuel remaining within the cylinder after each power stroke. This unburned fuel is consequently discharged along with the products of combustion during the exhaust portion of the cylinder cycle.

It is well known in the art to provide an internal combustion engine of the diesel type wherein the heat of compression of the air charge causes ignition of the fuel which is injected under high pressure to the cylinder at or near the beginning of the power stroke. This type of combustion and ignition system also results in unburned or partially-burned fuel remaining in the cylinder after each power stroke and, therefore, combustion is incomplete. This of course results in inefficiencies of the engine as well as undesirable pollutants being emitted into the atmosphere.

The emissions from automobile engines have been regulated for many years by the government and have posed a significant problem to automobile manufacturers. Many automobile manufacturers have attempted to control the emissions for internal combustion engines by using various devices including employing relatively expensive catalytic convertors and the like. These devices tend to decrease the overall efficiency of the automobile because of their load on the engine system. Furthermore, these devices are nowhere near 100% effective in removing all of the emissions generated by the internal combustion engine. Thus, a measurable amount of pollution is still being exposed to the environment.

In view of the above problems, it would be desirable to provide an internal combustion engine system that is an improvement over the above-mentioned conventional designs. Such an improvement should provide for rapid and complete combustion at high intensity throughout a part of, or all of, the power stroke as may be necessary in order to obtain substantially complete combustion at high mechanical work efficiency of an engine. Such a system should also substantially or completely eliminate all of the emissions caused by the internal combustion engine and, therefore, should eliminate the need for expensive complex exhaust systems that are presently being used with automobiles.

SUMMARY OF THE INVENTION

It is an object of the present invention to provide an internal combustion engine system that overcomes the problems mentioned above. Such an internal combustion engine system should substantially, if not entirely, eliminate the emissions produced by the engine without the assistance of costly exhaust systems. As a result, a cleaner burning system is derived which results in fewer deposits accumulating within the system, which, in turn, lowers maintenance costs.

It is another object of the present invention to provide an internal combustion engine that replaces the conventional single heat-spaced producing spark that is used for igniting the fuel-air mixture during the combustion cycle of the cylinder operating cycle.

It is also another object of the present invention to provide an energy conversion system that may be used wherever it is desirable to produce high mechanical work efficiency as well as to reduce emissions.

A first preferred form of the present invention provides as one of its aspects, a novel internal combustion engine system that includes an ignition system that produces extremely short, very high intensity discharges of energy bursts which fragment the fuel molecules into negative and positive ions, disassociate the ions and accelerate the negatively-ionized species with high-kinetic energy into a volume of a combustion chamber. The positively-ionized species form on or near the active cathode, i.e., the piston, and the highly-charged negative ions possess equally strong neutral repulsion. Because the negative and positive ions are very fast, have mutual repulsion, are instable, and are composed of dissociated molecular fragments, they tend to simulate very hot, very small, or highly-reactive fuel-gas molecules or plasma that scatter throughout the combustion chamber in a plurality of generally circular patterns. The result is that the highly-charged ions react while being disseminated throughout the combustion chamber and combust completely at high thermal intensity almost simultaneously throughout the combustion chamber before the appearance of a normal flame front.

The high intensity discharges or flames appear at essentially the same instant throughout the combustion chamber and happen at the very beginning of the power stroke, regardless of the fuel vapor present at that instant, which causes rapid vaporization and ignition of the remaining fuel air deposits that were not previously fragmented, dissociated, dispersed and activated by the initial high-intensity energy bursts. Thus, the above-mentioned internal combustion engine and ignition system results in the fuel mixture being completely, or almost completely, consumed during the early part of the power cycle when the thermal output can produce the greatest mechanical efficiency while leaving virtually no trailing combustion or unburned fuel at the end of the power stroke when the exhaust valve opens.

A second preferred form of the present invention provides as one of its aspects, a novel two-piece piston to be used in the internal combustion engine system described herein. Said piston comprising an upper body, a lower body, a plurality of springs disposed between said bodies, and fastening means that connects said bodies together. Because the internal combustion engine system described herein has increased work efficiencies which add additional stresses to the rotating components of the engine, the piston has been designed to absorb the shock and energy generated during the power stroke which results in smoother engine operation.

A third preferred form of the present invention provides as one of its aspects an ignition system which includes a novel compliant electromagnetic device (CEMD) having an electromagnetic pulsating circuit that preferably provides approximately 10,000 bursts of energy per second to the cylinders of the engine at a peak voltage of approximately 35,000 volts. The circuit is comprised of a rechargeable inductor capable of nearly instantaneously releasing its stored energy and nearly instantaneously recharging, a power source for recharging the inductor, and a field of matter that absorbs and dissipates the inductor's energy as well as controls the timing and frequency of the inductor's discharge into the combustion chamber of the engine.

A fourth preferred form of the present invention provides as one of its aspects a unique energy conversion system comprised of an electromagnetic circuit which includes a power source, a compliant electromagnetic device (CEMD) electrically connected to the power source, spaced apart electrodes connected in series to the CEMD, and a field of coherent matter in motion approximate to the spaced apart electrodes. The CEMD is operable to produce rapid high energy bursts to the field of matter which results in efficient and high energy conversion.

And, a fifth preferred form of the present invention provides as one of its aspects an improved internal combustion engine system that employs a compliant electromagnetic device that supplies high energy pulses to a distributor which sequences and directs said pulses to an engine system employing a unique high pressurized fuel recirculation system and plasma ignitor housing. The fuel recirculation system has an intake opening in communication with the combustion chamber which draws non-combusted fuel/air particles into a low pressure pump that redirects the recirculated particles to a delivery tube that simultaneously delivers high pressurized heated fuel from a fuel tank to the plasma housing assembly. The fuel delivery system preferably delivers pressurized heated fuel to the housing assembly just prior to the piston reaching top dead center and continues to do so until approximately 45° of crankshaft rotation is achieved. The presentation of fuel to the housing assembly is correlated with the ignition of a high intense electromagnetic pulse which is generated by the compliant electromagnetic device and transmitted through the timer/distributor to the anode which has an electrode positioned within the housing assembly whereby said pulse or spark is released. The pulse causes subsequent fragmentation and dissociation of the electrons and protons which subsequently causes intense thermal build-up of the high order in a period of nanoseconds which causes nearly complete combustion, if not entirely complete combustion, of the ionized fuel particles. Furthermore, the exhaust and intake vanes have overlapping areas which provide for enhanced cooling of the combustion chamber.

From the following specification taken in conjunction with the accompanying drawings and appended claims, other objects, features and advantages of the present invention will become apparent to those skilled in the art.

BRIEF DESCRIPTION OF THE DRAWINGS

FIG. 3 illustrates graphically the angular positions of the low-voltage rotor timing segments in relation to the four-cycle crankcase sequence with the degrees of rotation indicated;

FIG. 4 is a simplified wiring diagram of the FIG. 1 system where illustrated is the electrical components connected to one cylinder of a four-cycle engine system;

FIG. 5 schematically illustrates the demand control of the phase-coherent electromagnetic pulsing systems of matter in motion on the compliant electromagnetic device;

FIG. 7 is a cross-sectional view of one cylinder of the internal combustion engine and illustrates the piston at or near top dead center at the instant of the first part of the first high energy burst;

FIG. 7A illustrates graphically the energy/time relationship of the early part of ignition when the piston is in the position illustrated in FIG. 7;

FIG. 8 is a cross-sectional view of the piston located within the cylinder when the piston is at top dead center and at the instant in time immediately after the first burst has taken place within the combustion chamber;

FIG. 8A illustrates graphically the vector summed equivalence of all of the electromagnetic fields as well as the positioning of the ions within the combustion chamber at the instant in time represented in FIG. 8;

FIG. 8B illustrates graphically the energy/time relationship occurring at that instant in time represented in FIG. 8;

FIG. 9 is a cross-sectional view showing the piston located within a cylinder when the piston is located at top dead center and at the instant following the oscillation represented in FIG. 8B;

FIG. 9A illustrates graphically the vector summed equivalence of all of the electromagnetic fields as well as the positioning of the ions at the instant in time represented in FIG. 9;

FIG. 9B illustrates graphically the energy/time relationship at the instant in time represented in FIG. 9;

FIG. 10 is a cross-sectional view of a piston in a cylinder with the piston at about 30° beyond top dead center which is the time of approximately the sixth pulse or burst of energy of the same power stroke shown in FIGS. 8 and 9 above;

FIG. 10A illustrates graphically the vector summed equivalence of all of the electromagnetic fields as well as the positioning of the ions at the instant in time represented in FIG. 10;

FIG. 10B illustrates graphically the time/energy relationship at the instant in time represented in FIG. 10;

FIG. 12 is a cross-sectional view of an alternative embodiment piston arrangement which offers advantages over conventional pistons that are used in internal combustion engine systems;

FIG. 13 illustrates schematically one cylinder of an alternative embodiment engine system employing a closed-loop plasma circulating system for a four-cylinder, four-cycle internal combustion engine;

DETAILED DESCRIPTION OF THE PREFERRED EMBODIMENTS

Figures 1, 2:
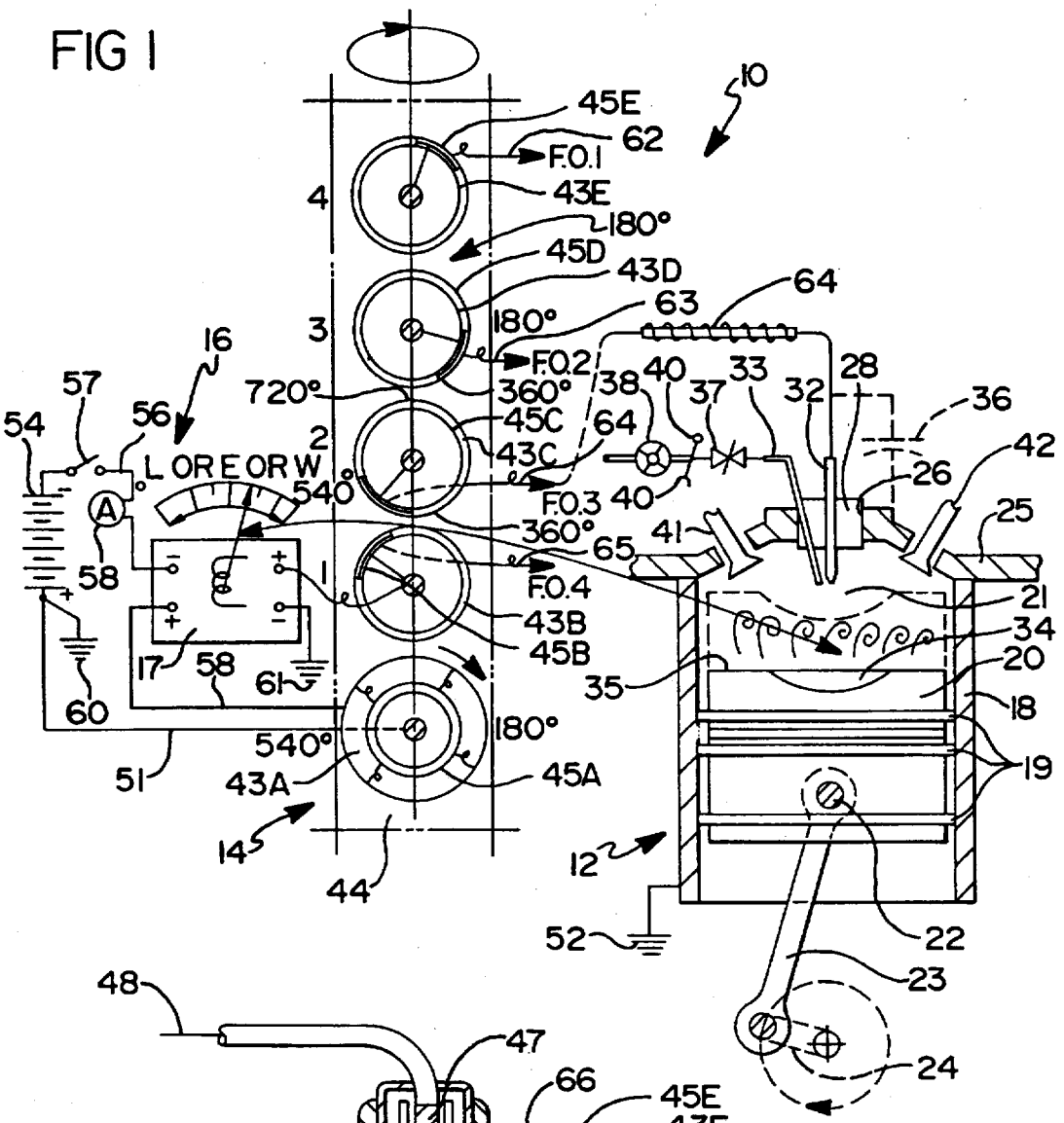
FIG. 1 illustrates schematically one cylinder of a four-cylinder, four-cycle internal combustion engine of the present invention with its compliant electromagnetic device, the electrical timer/distributor and one cylinder of a four-cycle engine.
FIG. 2 illustrates schematically a preferred form of the electrical timer/distributor to be used with the novel four-cylinder, four-cycle engine.

The novel internal combustion engine system 10 is illustrated in FIG. 1 and may be a single cylinder engine, a four or six or even an eight cylinder engine, or the like, and may be of either the four cycle or of the two cycle type. For discussion purposes, a four-cycle four-cylinder engine has been referred to. It will be appreciated that the scope of the technology presented herein may be extended to other applications where combustion of a fuel is desired, for example, in jet engines and furnaces. The use of this technology is clearly applicable wherever it is desired to more efficiently combust a fuel, for example, hydrocarbons, and to increase mechanical efficiencies while minimizing if not entirely eliminating emissions. This may be accomplished by employing a comprehensive dynamic electromagnetic system which converts a fuel into a plasma-like state whereby the exchange of energy is by means of discrete quanta-like pulses within an electromagnetic field that is ever changing.

The primary components of the novel internal combustion engine system 10 includes an internal combustion engine 12, a timer/distributor 14, and a compliant electromagnetic device 16. The compliant electromagnetic device (CEMD) 16 includes an electromagnetic pulsing circuit 17 (see FIG. 6) which serves the general purpose of rapidly imparting high intensity pulses or bursts of kinetic energy into a selected or predetermined amount of hydrocarbon fuel. These bursts of energy result in concurrent, momentary, rapidly repeated increases in the inherent internal kinetic energy of many of the fuel particles, thereby causing these highly energized particles to resonate at very high electromagnetic frequencies, which are ultimately manifested by very high electron and ion temperatures and high intensity reaction with the atmospheric air located within the combustion chamber of the engine 12. By repeating these resonant movements and temperatures very rapidly, the average temperature of a defined volume is increased sufficiently to cause rapid and substantially complete vaporization and/or sublimation of available low-energized particles of fuel with their subsequent combustion. The entire sequence, rapidly repeated in the order of several thousand times per second, produces substantially complete vaporization, i.e. combustion and energy conversion. Thus, wherever complete or nearly complete energy conversion is desired, the technology disclosed herein may be applied. Further details of the compliant electromagnetic device 16 and its circuitry 17 will be presented later.

THE ENGINE

Referring to FIG. 1, the engine 12 includes four-cylinders 18 (only one illustrated) which each have cylindrical walls that may be a sleeve recessed within a bore of an engine block (not shown). Within each cylinder, a piston 20 and piston rings 19 are provided. A bore passes through the outer circumference of the piston 20 where a conventional piston pin 22 is rotatably connected to a piston rod 23. The opposite end of the piston rod 23 is connected to a conventional crankshaft 24 for reciprocating the piston upwardly and downwardly and for transmitting the power during the power stroke of the engine cycle.

The engine 12 further includes a cylinder head 25 that is preferably formed from conventional suitable materials such as aluminum alloy, and is substantially symmetrical about a central longitudinally extending axis. The cylinder head 25 has a bore 26 for receiving a dielectric ceramic body 28 which is rigidly secured to the cylinder head 25. A gasket 30 and clamping ring 31 (See FIG. 7) may be used to releasibly secure the ceramic body 28 to the cylinder head 25 so that the body 28 may be conveniently removed and serviced. Standard bolts may be used to attach the ring 31 to the head 25. However, the ceramic body 28 must be secured to the cylinder head 25 sufficiently so that it will withstand the high pressures to which it will be subjected to. Furthermore, the cylinder head 25 may be provided with outer jackets to assist in cooling the engine 12.

The ceramic body 28 has two passageways formed therein for receiving an anode 32 and a liquid fuel jet 33, the anode 32 is preferably made of ceramic or could be made of a metallic/ceramic material. The liquid fuel jet 33 is oriented such that it is slanted and directs liquid fuel into the concave depression 34 of the piston 20. It is preferable to position the anode 32 in a substantially vertical orientation with respect to the top surface 35 of the piston.

The ceramic body 28 provides a path for very high energy, very short-time bursts of energy to enter the cylinder 18 without undue blocking or choking. Together, the ceramic body 28, the anode 32 and the metallic cylinder head 25 may be comprised as a unit as an electrical capacitor which is illustrated in an equivalent manner by item 36 in FIGS. 1 and 4. Also, the ceramic body 28 is of sufficient dimensions such that the distribution pattern of the kinetic materials of each energy burst or pulse is of a preferred density in a geometrical sense, meaning that there is no cathodic surface in the general area of the anode 32.

The liquid fuel jet 33 is preferably not of the "atomizing" or spray type as conventionally used in internal combustion engines. The type of liquid fuel jet 33 employed herein directs an essentially homogenous stream of liquid hydrocarbon fuel during a short burst into the concave depression 34 of the piston 20. One of the benefits of this internal combustion engine system 10 is that it may operate on various types of liquid hydrocarbon fuels for example, kerosine, leaded or unleaded gasolines, gasoline with or without solvent additives, and gasolines having high or low octane. Furthermore, because of the unique design of this engine system, the highly volatile hydrocarbon ends in the fuel such as pentane or butane will not cause operating malfunctions, for example, vapor locks. Also, the vapor temperature of the liquid fuel is not an important requirement in order to make the engine function from either the standpoint of starting or operating, in either cold or hot weather. It is preferable, however, to provide a vapor temperature of approximately 200° F.

Other components of the novel engine 12 includes a fluid control valve 37 that is connected to one end of the fuel jet 33. The control valve 37 is preferably mechanically driven by a cam arrangement on the engine assembly so that the interval of liquid fuel injection is properly timed with respect to the engine four-cycle crankshaft position, when the precise amount of fuel for a stoichiometric to under-stoichiometric fuel mixture is injected immediately prior to the initial high intensity pulse or burst when the piston is at top dead center (T.D.C.) or very near T.D.C. for the power stroke. At least one control valve 37 is required for each cylinder of the engine and it is preferred to provide a control valve 37 that is capable of fast operation in order to admit liquid fuel in the shortest practical time.

The engine 12 further includes a conventional fluid-handling gear pump 38, or other similar device, that maintains an elevated fluid pressure for the fuel supply to each control valve 37. The capacity of the gear pump 38 is preferably in the order of four gallons per minute and must be capable of providing a pressure in excess of the maximum compression of an engine cylinder during the compression cycle. For example, if the engine compression ratio is 12:1, the pump should be capable of producing 250 PSIG or thereabouts. It will be appreciated that, upon start up, the pump 38 could be electronically driven; thereafter the pump could be driven by some other sort of mechanism. For each cylinder 18 of the engine 12, a conventional liquid fuel branch line 40 must be provided and connected to the fuel pump 38 at a location upstream from each control valve 37.

The engine 12 further includes conventional intake valves 41 and exhaust valves 42. It will be appreciated that a plurality of valves may be provided for each cylinder of the engine 12 in order to achieve the desired engine performance.

THE TIMER/DISTRIBUTOR

FIG. 1 further illustrates a time/distributor device 14 to be used in conjunction with a four-cylinder engine. The distributor 14 is hooked in series with the compliant electromagnetic device 16 and has a fundamental purpose of directing the high energy pulses created by the compliant electromagnetic device 16 to the appropriate cylinder of the engine 12. FIG. 1 further illustrates a particular sequence of the engine cycle where the distributor 14 is directing a high electrical charge to the cylinder 18 designated having firing order number 3 (F.O.3). The distributor 14 is comprised, in a four-cylinder engine, of a stacked assembly of five dish-type like dielectric housings or stack elements 43A through 43E that are all encapsulated within a sealed housing 44 and protected from the atmosphere.

The distributor 14 is further presented in FIG. 2 where illustrated therein is a section through a compartmentalized distributor 14 which depicts stator conductors 45A through 45E located within the stack elements 43A through 43E, and connected to associated rotor arms 46A through 46E. A rotatable shaft 47 preferably made of metal has rotor arms 46B through 46E rotatably connected thereto which are electrically-conductive. The shaft 47 represents an extension of electrical wire 48 which is connected to the compliant electromagnetic device (CEMD) 16 and transmits the high energy pulsating burst of energy created by the CEMD into the distributor 14. Another rotatable shaft 50 is provided and has rotor arm 46A connected to it in the bottom stack element 43A which is also electrically conductive and is in effect an extension of wire 51. The drive shaft 50 and wire 51 are connected to a common ground 52. A coupling 53 is provided which is electrically non-conductive and serves as a drive coupling positioned between shafts 47 and 50 with the other end of the shaft 50 being connected to the engine by conventional methods.

Stator conductor 45A preferably opens and closes a twelve-volt battery circuit 54 to the CEMD 16 which is connected by wires 51 and 55. The connection of the CEMD 16 is completed by wire 56 through a control switch 57. A battery ammeter 58 is shown for illustration purposes only and may indicate six amps or more during engine operation. However, the short-term demand current drawn from the battery is of a very much higher order, as will be illustrated by oscillograms hereinafter. Thus, the current capacity of stack element 45A, wires 51, 55, 56 and switch 57 should be in excess of the nominal six amperes requirement, for example in the order of 30 amperes. A grounding connection 60 is provided on the battery 54 while a ground connection 61 on the CEMD 16 goes directly to the engine body ground 52 which is normally cathodic. Thus, grounds 52, 60 and 61 in effect constitute a common engine body ground.

The distributor 14 directs the current generated by the CEMD 16 by a series of wires connected to the stator conductors 45A through 45E. For example, in a four-cylinder engine, which is the type of engine the distributor 14 is set up for, a wire 62 is provided and is connected to stator conductor 45E and to the cylinder in the first-firing order (represented by F.0.1). Wire 63 is connected to stator element 45D and is connected to the cylinder having firing order number two (F.0.2). Likewise, wires 64 and 65 are connected to stator conductors 45C and 45B to the cylinders having firing orders number three (F.0.3) and four (F.0.4), respectively. It will be appreciated that, if a firing order other than a straight line sequence of one, two, three or four is desired, then the stator conductors 45B through 45E must be properly connected.

It is preferable that wires 62 through 65 are made of eighteen gauge copper wire which possesses high conductivity in order to withstand high peak potentials in the order of 40 KV. A ground shield blade may be applied over the dielectric in order to provide a complete assembly similar to a coaxial cable. Such a cable is shown in FIG. 1 where wire 64 is shown connected to the upper end of anode 32. It will be appreciated that, for each cylinder of the engine, the wires 62, 63 and 65 will be connected to the anode in a similar fashion.

Each stator conductor 45A through 45E has outer peripheral elements 66 that represent the electrically-conductive portion of the stator conductors of the stacked distributor 14. Each rotor arm 46B through 46E is connected to shaft 47 which connects to power source wire 48, while rotor arm 46A is connected to wire 51 or the ground wire 52. It will be appreciated that another type of timer/distributor device may be employed in place of that disclosed herein as long as it is operable to sequence the delivery of high energy pulses to the appropriate engine cylinder and withstand the conditions associated with an engine.

A discussion will now be presented regarding the energization sequence of the distributor. It is important to note that the CEMD 16 may only be connected to one stack element at a time so that it is an integral part of only one kinetic electromagnetic system of suitable matter in motion at any given time. Thus, only one cylinder of the engine 12 may be energized at any particular point in time by the CEMD 16. This is accomplished by the distributor 14 regulating, or sequencing, the high intensity electromagnetic burst of energy generated by the CEMD 16.

An example of this energization sequence would be when stator conductor 45A closes the battery power source to the CEMD 16 when the cylinder with firing order number one is at or very near T.D.C. for the power stroke. Simultaneously the rotor of element 45E closes the CEMD circuit 17 to the cylinder represented by firing order number one (F.0.1). This is clearly illustrated in the schematic depicted in FIG. 3. Here energization occurs of the cylinder representing firing order number one for approximately 120°, more or less, of the crankshaft rotation at which time the battery power source is disconnected from the CEMD 16 when rotor arm 46A clears the end of stator conductor 45A. This process allows more than ample time for the CEMD 16 to re-establish itself before the same sequence is repeated for the cylinder having firing order number two (F.O.2) and for the remaining cylinders F.O.3 and F.O.4. It is preferred that this restoration time for the CEMD 16 be in the order of microseconds in order to attain the desired results.

FIG. 4 illustrates a simplified wiring schematic of the FIG. 1 system and shows the key components of the internal combustion engine system 10 with one cylinder 18 of an engine 12 being illustrated. Here the electrical circuit for a particular instant in time is illustrated whereby the cylinder in the first firing order is connected to wire 62 which is directly connected to stator conductor 45E which, in turn, is connected to the positive terminal of the compliant electromagnetic device 16. Likewise, stator conductor 45A is connected to the compliant electromagnetic device 16 and the power source 54. The capacitor 36 is shown in parallel with the piston 20 and represents the equivalent capacitance of the ceramic body 28, the cylinder head 25 and the coaxial cable 62.

The approximate full capacitance of capacitor 36 may be in the range of 40 to 70 micro-farads with 50 micro-farads being the preferred value. The smaller the value of the capacitor the faster the pulse repetition rate (PRR) for the modes depicted in FIGS. 8A and 8B. However, the modes depicted by FIGS. 9A, 9B, 10A and 10B are not appreciably affected by the values of capacitor 36. Thus, the change in the electrical value of capacitor 36 is useful in certain cases. For example, for a relatively small but very high-speed engine, a fast PRR with moderate energy bursts would be preferred; whereas in a very large, low-speed engine, a slow PRR with intensely high bursts could be used.

FIG. 5 illustrates schematically a simplified representation of the electrical circuit for a particular instant in time wherein the electromagnetic properties of the matter in motion 72, i.e., air/fuel particles, within the combustion chamber 21 at any given time essentially controls the CEMD 16. Thus, the matter in motion within the combustion chamber 21 acts as a controller because of the continuous change in inductance, resistance and capacitance of said field of matter. Because this dynamic occurring change of electromagnetic properties in the combustion chamber 21, the CEMD 16 accordingly changes its voltage output and current upward. This demand control is illustrated by arrow 68 which leads from combustion chamber 21 and shows that the inductance of the component CEMD 16 can be varied from maximum to zero by control of the resonating matter 72 within the combustion chamber. Thus, the voltage, current and power capability ranges the full spectrum of zero to maximum depending upon the electromagnetic properties of the matter within the combustion chamber 21.

THE COMPLIANT ELECTROMAGNETIC DEVICE

Figure 6:
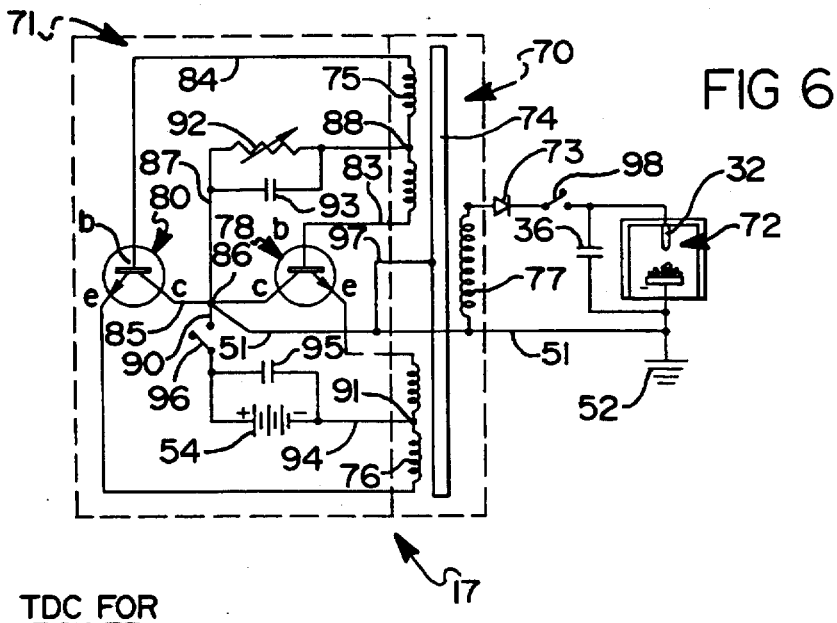
FIG. 6 is a schematic wiring diagram of the electromagnetic pulsing circuits connected to one cylinder of a four-cycle engine system with the timer/distributor removed for clarity purposes.

The compliant electromagnetic device 16 essentially consists of an electromagnetic pulsing circuit 17 that is capable of rapidly imparting high intensity pulses or bursts of kinetic energy into a selected or predetermined amount of fuel. FIG. 6 illustrates the schematically electromagnetic pulsing circuit 17 connected to one cylinder of the engine 12. For simplification purposes, the distributor 14 has been left out. However, it will be appreciated that the circuit presented in FIG. 6 may be used with combustion devices that do not require a distributor, for example, a furnace.

The primary components of the pulsating circuit 17 includes a rapidly rechargeable inductor 70 which is capable of almost instantaneously dumping its stored electromagnetic energy, a power source 71 for rapidly recharging the inductor 70, and a field of matter 72 (which acts as a load) connected in series with a polarizer 73 to the inductor 70 as a load for absorbing and dissipating the inductor's energy as well as for controlling the timing of and the quantity of the inductor's discharge.

The inductor 70 is formed of a magnetically permeable core 74 having primary windings 75 and 76 and a secondary winding 77. The magnetically permeable core 74 is preferably formed of a ferrite material which is characterized by its ability to function at extremely high electromagnetic frequencies without excessive eddy-current or hesterisis losses while also possessing dielectric as well as magnetic properties. The ratio of turns of the secondary winding 77 to the primary windings 75 and 76 is very high, as for example, 1,625 to 1 for each half of the primary winding 76 and 930 to 1 for each half of primary winding 75. Furthermore, the wire that is used for the windings is preferably selected from a suitable material having a low resistance. The internal D.C. resistance of the entire inductor assembly is low, such as in the order of 500 ohms or less at room temperature.

The peak energy of the inductor's discharge can be increased by decreasing the internal resistance of the inductor windings. This may be accomplished by increasing the diameter of the wire used for the winds by enclosing the inductor assembly in a suitable cryogenic environment in combination with using suitable cryogenic materials in the construction of the inductor assembly.

Because of this novel design and construction, the inductor 70 is capable of being rapidly recharged, in increments or steps, between its discharges into the combustion chamber 21, and will almost instantaneously discharge a burst of energy from its secondary winding 77. The power source 71 when combined with the inductor 70 forms a complete circuit which is similar to a push-pull, regenerative feedback oscillator.

The primary components of the power source 71 includes a pair of transistors 78 and 80 whose emitters (e) are connected by wires 81 and 82, respectively, to the opposite ends of the primary winding 76. The bases (b) of the transistors are connected by wires 83 and 84, respectively, to the opposite ends of the other primary winding 75. Each transistor 78 and 80 has collectors (c) that are connected to each other by a wire 85, which has a common connecting point 86, which is in turn connected by wire 87 to a center tap 88 of winding 75, and by wire 90 to a center tap 91 of winding 76. A variable resistor 92, e.g., a rheostat or a fixed resistor plus a rheostat, is connected in series with wire 87. A capacitor 93 is connected in parallel with the variable resistor 92. The resistor 92 functions to furnish the bias voltage for the transistor base element (b). This controls the average current level into the transistors 78 and 80 from the battery 54, and likewise prevents signal flow through the battery 54.

The power source used to generate the requisite voltage and current is preferably a low voltage battery 54 which is connected in series with wire 94 and is preferably a 12-volt D.C. battery. A capacitor 95 is parallel or shunt connected across the battery 54 and a conventional on-off switch 96 is located in series with battery 54 and operates to turn the power on or off in order to actuate and deactuate the circuit 17.

The common connecting point 86, to which wires 85, 87 and 90 are connected, is itself connected to a common ground buss or wire 51, to which the inductor core 74 is also connected by a grounding wire 97. This connection between the core 74 and buss 51 assists in maintaining a stable dielectric value of the core 74. The buss 51 may be remotely grounded to the engine or body at 52.

With continued reference to FIG. 6, the field of matter or load 72 essentially consists of the vector summed equivalence of the electromagnetic fields generated by the particles of air and fuel mixture that reside within the combustion chamber at any given time during the engine cycle. The anode 32 is connected to an on-off switch 98. The capacitor 36 is connected in parallel with the anode 32 and piston 20 (cathode) for receiving and passing on energy discharges from the inductor 70.

It will be appreciated that other power sources 71 may be employed as long as it satisfies the requirements herein. In short, the power source and inductor must be capable of cycling anywhere up to 10,000 times per second with the inductor energy discharges varying from less than one joule to up to fifteen million joules. A typical cycle will have an order whereby the time for inductive discharge is approximately 0.02 microseconds, which is followed by the resonant movement or oscillation of the particles within the combustion chamber which lasts approximately 3.5 microseconds. Each oscillation during this step is along the order of 0.05 microseconds. Thereafter this is followed by approximately 300 microseconds of incremental or step-by-step recharging (no oscillation) of the inductor 70. The inductor 70 then discharges again and repeats the above-mentioned cycle again. Only after the discharge or pulse has stopped, the CEMD 16 gradually restores its electromagnetic capabilities within itself, meaning that relatively steady inductance and capacitance parameters are gradually gained. This period of regaining it's energy essentially is the step-by-step recharging between the pulses. Thus, a pulse repetition rate (PRR) of approximately 300 microseconds is preferred and essentially is that time in which it takes the CEMD 16 to become a DC device so that it may serve again as an electrostatic accelerator at the start of the next pulse.

When the inductor 70 discharges across the electrode gap created by the anode 32 and piston 20 (cathode), each time its stored charge is sufficient to rupture the dielectric charge between the electrode gaps. Thus, the inductor 70 may discharge after it is fully charged or it may discharge sometime before it reaches its maximum charge, depending upon the relationship between the stored energy and the dielectric strength of the particles of matter in the gap. If it discharges before maximum charge, it obviously discharges a smaller amount of energy. However, it then begins recharging sooner.

This is but a brief description of the relationship between the components of the CEMD 16 and the energy bursts it provides to the combustion chamber of each engine cylinder 12. The following discussion will be of the method of operation of the internal combustion engine system 10 with specific attention to the positioning of the piston 20 during the various cycles of operation.

During operation, the electromagnetic parameters of the field of matter 72 that is in motion essentially control the electromagnetic circuit including energy magnitudes whereas the capacitance, inductance and resistance parameters of the CEMD 16, do not control. Another unique aspect of this invention is that the CEMD 16 is compliant to the energy demands of the matter in motion 72 and thus delivers only the amount of kinetic energy that is required for any pulse. When this electromagnetic circuit is in existence during the period of the pulse, the inductance of the CEMD 16 intermittently disappears while the capacitance also alternately disappears or shifts suddenly in value. This is due to the cancellation effect by the capacitance in the primary winding opposing capacitance of the secondary winding when a high frequency high amplitude oscillation burst of energy appears in the primary circuit of the CEMD 16. When either the inductance or capacitance or both the inductance and the capacitance are lacking within the resonant tank circuit 73, the CEMD 16 is not by itself an operable electromagnetic entity. Thus, the inductance, capacitance and resistance parameters of the field of matter in motion 72 as illustrated in FIGS. 8*a*–10*a* and the CEMD 16, function as a unit electromagnetic circuit 17. Here the matter in motion 72 controls the energy and time parameters of the resonating tank circuits 73 which are in the process of the receiving, storing and transferring energy as required by the matter as it builds up its excitation and further calls upon the CEMD 16 as necessary during the process of excitation build-up. Thus, the electromagnetic circuit 17 has a key component which is the resonating tank circuit 73 which is dynamic and includes matter in motion which is in plasma or plasma-like states which exists in the form of very mini electron and ion resonances during the life of each pulse. As the time, amount and state of matter between and within the field of matter changes, the electromagnetic resonances change accordingly. As a result, the pulse repetition rate, the wave forms, the duration of the pulse, the amount of energy in the pulse and the frequency or frequency composition, are all required by and controlled by the matter in motion 72 in the electromagnetic circuit 17 at any point in time. Thus, an infinite number of electromagnetic circuits 17 may be demonstrated, only three of which are shown in FIGS. 8*a*, 9*a* and 10*a*.

Referring now specifically to FIG. 7, the piston 20 is illustrated in its top dead center (T.D.C.) position at the start of the power cycle, when a spurt of liquid fuel has just been injected over a period of approximately 2 milliseconds and which has ended an instant before a kinetic energization occurs by the discharge from the anode 32. At this time, the CEMD 16 has delivered to the combustion chamber a high intensity polarized discharge at the maximum potential capability of the CEMD 16, which is preferably in the order of 35,000 volts equivalent D.C. At this instant in time, the peak current from the CEMD 16 is also very high, and is preferably on the order of 400 amperes. Furthermore, during this same instant in time, the CEMD 16 is acting like a molecular fragmenter and electrostatic accelerator as simultaneously the fragments 100 are dissociated within the combustion chamber 21. The fragments 100 that are large liquid molecules tend to collect near the vicinity of the concave depression 34 of the piston 20 (which acts as a cathode) and cracks the hydrocarbon fuel into fragments 100 that are highly charged positive 101 and negative 102 ions which instantly dissociate from one another.

The negative ions 102 are accelerated at high speeds away from the strongly-cathodic concave piston depression area 34, the cathodic walls of the metal cylinder 18 and from one another as well. Thus the negative ions 102 take on a spiraling trajectory as they become reactive. This essentially puts all of the fuel particles possessing the negative charge into a homogeneous volume of space and thereby establishes an electromagnetically-resonant state of matter which releases energy in the form of a fast burst and causes reaction of the highly-kinetic scattered volume prior to combustion. The consequence of this is that a high-intense flame appears virtually instant throughout the combustion chamber 21.

Meanwhile, the positively-ionized fuel particles 101 formed on or near the cylinder 18 and active piston 20 which acts as a cathode. The result is that these positive ion fuel particles 101 bombard the cathodic surfaces (those surfaces having a negative charge) to become very emissive and to precipitate an electron avalanche which in turn sustains the pulse or burst of high intense energy.

Referring now to FIG. 7A, the relationship between the voltage and current with respect to time is depicted. At the instant of the first pulse the mass density is very high and the atmospheric pressure is around 225 PSIG. The present system 10 is operable to provide a first pulse having 35,000 volts which may be delivered in approximately 0.02 microseconds to a field of matter.

FIG. 8 illustrates the piston 20 at top dead center at the instant in time immediately following the high-intensity accelerating start of the first burst or pulse illustrated in FIG. 7 and the related coherent electromagnetic conditions which could exist at that instant in time.

FIG. 8A illustrates within the broken circle the vector summed equivalence of all of the compatible electromagnetic fields within the combustion chamber at the instant in time represented in FIG. 8. This can also be thought of as a tank circuit 73 which is dynamic and continuously demanding energy input from the CEMD 16. Here all of the ions of one species are accelerated into a homogenous volume of space at the same time and at the same rate which establishes a summed electromagnetic state of matter in motion 72 in an overall compatible or coherent matter. Here the negatively charged ions 102 are shown swirling within the combustion chamber while the positively charged ions 101 are collected at or near the surface of the piston 20. The capacitor 36 oscillates at high intensity in a uniform manner until the instant of combustion of the fully and/or partially reacted negative and positive ionic fuel particles which are scattered throughout the combustion chamber 21. As indicated by the graph in FIG. 8B, combustion occurs after approximately 0.5 microseconds of oscillation by the capacitor 36. The peak voltage during this oscillation period is approximately 30,000 volts. Line L represents the period of time when the pulse is ignited.

Referring to FIGS. 9, 9A and 9B, the piston 20 is illustrated at a position immediately following the instant in time in which the flame appears within the combustion chamber 21. FIG. 9A illustrates schematically a resonant tank circuit 73 having a vector summed equivalence of all of the compatible electromagnetic fields at the instant time just after the flame appears within the combustion chamber 21. The electromagnetic resonance is now shifted rapidly and it may switch back and forth between the circuit modes illustrated in FIGS. 8A and 9A by the switch 1 (SW1) that is in parallel with a switch 2 (SW2) located in the tank circuit 73. The SW2 is further shown in series with the capacitor which, in turn, is in parallel with the conductor and the resistor. Thus, the inductance, capacitance and resistance values or parameters of the tank circuit 73 are dynamic. FIG. 9B is representative of the voltage/time relationship during that instant in time represented by FIGS. 9 and 9A. Here the heavy dots illustrated in the graph illustrate electron cyclotron-like spins which are representative of points of extremely high temperatures. That portion of the engine cycle which is represented by FIGS. 9, 9A and 9B takes approximately 3 microseconds and reaches an approximate maximum peak voltage of 8,000 volts.

FIGS. 10, 10A and 10B are representative of that instant in time just after the pulse of energy which could be the sixth pulse for the same power stroke illustrated in FIGS. 8 and 9. Here the crankshaft has rotated approximately 30° from T.D.C. and the air/fuel mixture within the combustion chamber has substantially all, if not entirely, been consumed and the flame has been extinguished thus leaving only carbonaceous residue 103 which often includes positive carbon constituents. The residue 103 has been grounded out on the active cathode or piston 20 and is oxidized by the attack of the extremely hot plasma arc 104. This carbonaceous residue 103 appears to be composed of the same variety of carbon that constitutes the smoke in an otherwise good conventional combustion process, or that which causes a hard carbon to form within the walls of an engine.

Thus, the final step of the combustion cycle as represented by FIGS. 10 through 10B, essentially acts as a "smoke and carbon eliminator" that also has exothermic capabilities. The result is that the emissions from the internal combustion engine 12 are either substantially eliminated or entirely eliminated by this process. Therefore, it is believed that because of this efficient design, there may not be a need for afterburners or catalytic convertors in the exhaust system in order to eliminate or reduce the amount of carbon monoxide, raw hydrocarbons, nitrogen oxides, particulates, lead, emissions due to solvents, odor, etc., as is conventionally used in conventional internal combustion engines. Because the liquid fuel enters the combustion chamber 21 immediately prior to the piston reaching top dead center of the power stroke, the opportunity for generating peroxides, aldehydes and similar partly reactive compounds is eliminated. Conventional internal combustion engines do not overcome this problem because they generally introduce as a spray or vapor liquid fuel with the charging air during the power stroke whereby an explosion occurs producing high temperatures by impact as the reactive compounds collide with the advancing normal flame front. As such, the engine system 10 emits virtually no nitrogen oxides into the atmosphere. This of course is environmentally desirable.

Figure 11:
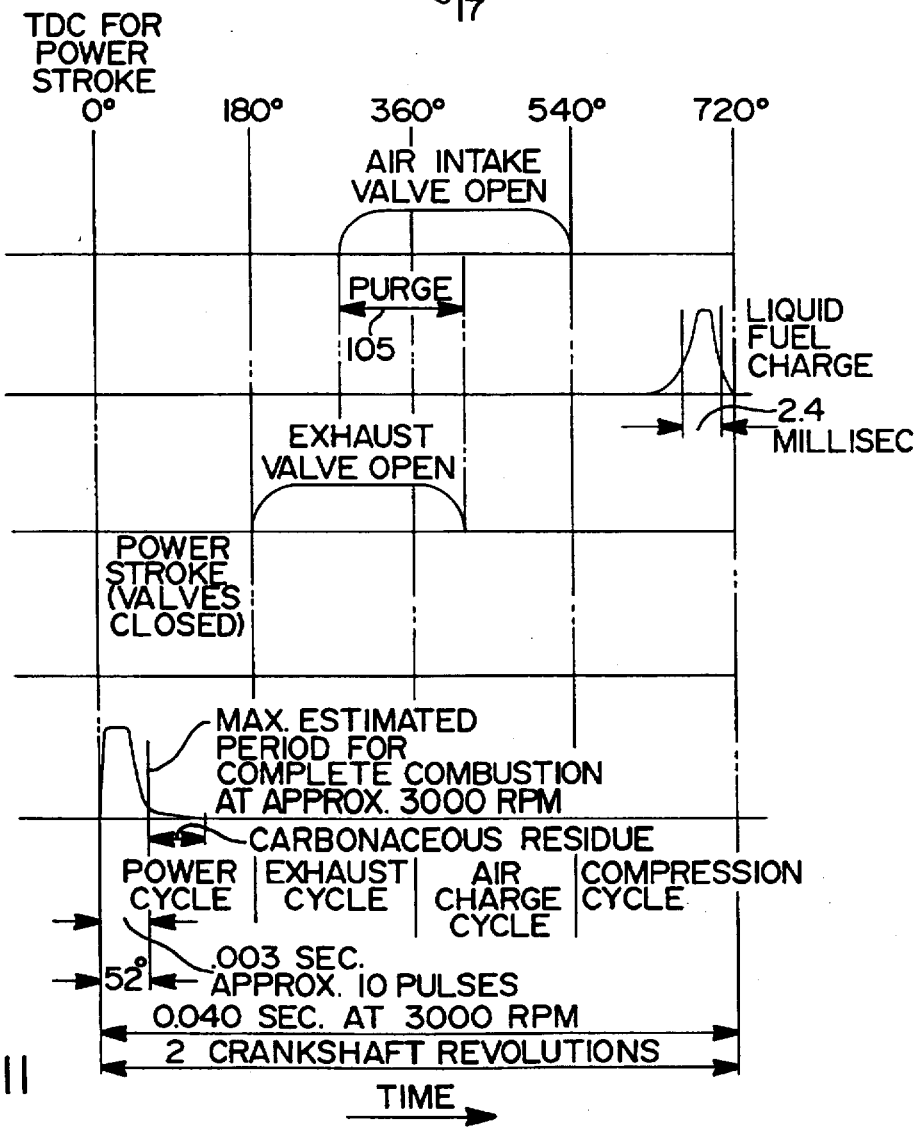
FIG. 11 is a graphic illustration showing the interrelationships between the air intake air valve, the exhaust valve, the liquid fuel charge and the combustion cycles.

FIG. 11 has been provided to assist in the understanding of the four-cycle operation of the present invention. Specifically, an additional feature of the present invention is illustrated where the exhaust value and the intake valves are provided with a large value overlap area 105 which effectively purges the cylinders 18 of any inert gases. This large overlap value area 105 also assists in the cooling of the inner elements of the combustion chamber 21, without bypassing raw hydrocarbons into the exhaust line and thus into the atmosphere. The estimated maximum period for complete combustion with an engine operating at about 3000 R.P.M. is approximately 52° of crankshaft revolution. It will be appreciated that the parameters as indicated in FIG. 11 are approximate.

FIG. 12 represents an alternative embodiment piston 110 to the piston 20 illustrated in FIG. 1. The primary components of the piston 110 includes an upper main body 111, a lower main body 112, a plurality of springs 113 disposed therebetween and a plurality of fasteners 114 securing the two bodies together. It will be appreciated that bolts or other fastening devices may be used in order to secure the upper and lower bodies together. Piston rings 19 are also used as discussed before. The resulting piston 115 absorbs the shock generated during the combustion process and therefore provides a smoother operating engine.

The upper body 116 includes a centrally disposed concave depression 115 for receiving fuel and also a lower mounting area 116. The lower mounting area 116 is preferably integral with the cylindrical side walls 117 and extends inward to define a rigid mounting area. Likewise, the lower body 112 includes an upper mounting area 118 that is substantially parallel to the lower mounting area 116 and is further preferably integral with the cylindrical side walls 117.

It has been revealed that essentially the entire fuel contents produced in the flame may be consumed within approximately 20° to 50° of crankshaft travel at approximately 3,000 revolutions per minute of the crankshaft. This of course is dependent upon the pulse repetition rate and the intensity of each pulse. This means that a high degree of mechanical work efficiency is generated by this internal combustion engine 10 when compared to burning over of the 180° period in a conventional engine cycle. The result of this faster burning imposes a heavier transient load on the engine rotating parts, for example, the bearings and the crankshaft. Thus, the novel piston 105 presented in FIG. 12 illustrates one means of reducing the mechanical stresses and friction losses as the efficiency is increased when the work is transmitted to the crankshaft in a much more gradual manner.

It will be appreciated that the fundamental idea of the present invention is generic and that it may be equally applicable to other technologies besides that of internal combustion engines. For example, the fundamental concept is illustrated in FIG. 5 whereby an energy conversion system 130 would be comprised of a compliant electromagnetic device 16 having a power source 54 connected to the CEMD 16, an anode 32 and a spaced apart cathode 20 located in a field of matter 72 that defines a electromagnetic resonating tank circuit 73 having dynamic inductance, capacitance and resistance parameters. The field of matter 72 may be deposited within a combustion chamber whereby the field of matter 72 is subjected to fragmentation, dissociation and combustion as previously set out in the detailed description above. A key application for this type of technology would be in the heating industry where the operation of a furnace could be substantially enhanced by the employment of the novel ignition system disclosed herein.

This novel energy conversion system 130 is yet another application of the present invention which results in more complete combustion of a fuel which enhances mechanical efficiencies while nearly eliminating, if not entirely eliminating, pollutants such as nitrogen oxides and carbon monoxides. It will be appreciated that, depending upon the type of fuel being burned, the pollutants generally emitted as a byproduct of the combustion process will be substantially eliminated, if not entirely eliminated.

FIGS. 13–19 illustrates yet another preferred embodiment internal combustion engine system 150 which employs further improvements to the previously discussed internal combustion engine system 10. This embodiment illustrates an enhanced plasma ignition system which recirculates non-combusted plasma by mixing it with high pressurized heated fuel which, in turn, is deposited within a cathodic plasma housing and subjected to repeated high energy pulses created by an electromagnetic device. It will be appreciated that this basic concept may be employed in other areas besides that specifically discussed herein. Where possible, the same reference numerals will be used to identify previously discussed elements.

Referring primarily to FIG. 13, the internal combustion engine system 150 is comprised of an engine 152 connected in series to the appropriate element stack of a distributor 14 which, in turn, is connected to a compliant electromagnetic device (CEMD) 16. The distributor 14 and the CEMD 16 have previously been thoroughly discussed and, therefore, no further discussion will be made here. For simplification purposes, only one engine system 152 has been illustrated as being connected to the distributor 14. In actuality, depending upon the number of cylinders of the engine, an engine system 152 would be provided for each cylinder of the engine and, accordingly, connected to the distributor 14 in the appropriate firing order as previously described above.

The engine system 152 includes a fuel recirculating system 154 that is in fluid communication with the combustion chamber 156 and with a fuel delivery system 158 that supplies pressurized heated fuel to the combustion chamber 156. The combustion chamber 156 is defined by a cylinder head 160 having intake valves 162 and exhaust valves 164 as well as a cylinder 18 capable of receiving the energy absorbing piston 110 previously discussed in FIG. 12. It will be appreciated that a one-piece piston 20 may be used as previously discussed with reference to FIG. 1.

The plasma recirculation system 154 includes an intake tube 166 that has an intake opening 168 in communication with the combustion chamber 156 for delivering non-combusted fuel particles 170 to a low volume gas pressurizing pump 172. A fluid return line 174 is connected at one end by a connector 176 to the low pressure pump 172 and, at the other end, is connected to a fluid delivery tube 178 that is preferably an integral part of a body 180 that is preferably made of ceramic material. The delivery tube 178 extends axially through the body 180 and delivers fuel to the combustion chamber 156 at an outlet 182. Thus, the recirculated non-combusted fuel particles 170 are drawn out of the combustion chamber 156 and subsequently mixed within the delivery tube 178 with fresh high pressurized heated fuel 184. It is preferred that the inner diameter of intake tube 166 be approximately 0.040 inches while the inner diameter of the delivery tube 178 should be approximately 0.050 inches. It is also preferred that the pressure differential established by the pump 172 to be approximately 60 psi across the intake tube 166 and the delivery tube 178.

Fresh fuel 184 is delivered to the delivery tube 178 by the fluid delivery system 158 that includes an input line 188 that directs fluid from a fluid reservoir such as a fuel tank (not shown). The input line 188 delivers low pressurized fuel to a conventional high pressurized fuel pump 190 that has sufficient capacity to deliver a constant supply upon demand of high pressurized fuel to each conduit 192 that extends to the heating device 194 of each cylinder. Thus, in a four-cylinder engine arrangement, there would be four conduits 192 extending to each heating device 194 in order to supply the requisite quantity of fuel to the combustion chamber 156.

The heating device 194 preferably provides an elevated temperature of ambient fuel and has a preferred volume of approximately 2 cubic inches and requires a low current draw. It will be appreciated that these physical properties may change, however, it is important to provide such a heating device 194 that will elevate the temperature of the fuel during winter operating conditions.

Downstream from the heating structure 194 the fluid delivery system 158 further includes a control valve 196 operable to control the flow of fuel into the delivery tube 178. A conventional check value 198 is provided downstream from the flow control valve 196 and prevents fluids from backing up into the fluid delivery system 158. The control value 196 preferably is solenoid controlled which will allow for rapid opening and closing of the value in order to sequence fluid delivery relative to the degree of crankshaft rotation. It is preferred that the control valve 196 start opening prior to the piston reaching top dead center (T.D.C.) and begin closing near 35° past T.D.C.

With continued reference to FIG. 13, the engine 152 not only includes the recirculating system 154 and the fuel delivery system 158, but also a plasma housing assembly 200. The plasma housing assembly 200 includes a heart-shaped housing 202 preferably made of dielectric material (i.e. ceramic) that is connected by an attachment structure 204 to the ceramic body 180. The housing 200 may further be provided with a grounding contact 206 which grounds the outer surface of the housing 200 with the cylinder head 160 for grounding purposes. Thus, the housing assembly 200 is cathodic. A holding structure 208 suspends a barrier element 210 (an electrode) within the housing 202 and both are preferably made of dielectric materials. An anode 32 is provided within the ceramic body 180 and delivers high energy impulses to an electrode 212. Thus, a spark gap 214 is defined between the positive electrode 212 and the cathodic barrier element 210. Within the housing assembly 200, high pressurized fuel is fragmented and dissociated into highly energized ion particles (plasma) which become ignited by the spark introduced to the gap 214 during the beginning of the power stroke.

The ceramic body 180 is secured in place by a conventional clamping ring 220 which, in turn, is secured by a fastening means 222 to the cylinder head 160. A gasket 224 is provided between the ceramic body 180 and the cylinder head 160 for assuring a gas tight seal.

The fluid delivery system 158 may further include a bypass circuit 230 which includes a pressure switch 232 and a check value 234 whereby the switch 232 senses fluid pressure caused by the fuel pump 190 and directs fuel back into the fuel pump 190. It will be appreciated that various arrangements may be provided with this bypass circuit, for example, the pressure switch 232 may be directly connected to the high pressure fuel pump 190 in order to send a signal indicative of a pressure reading which may be subsequently processed by the fuel pump. Also, the bypass circuit could be routed to return excess pressurized fuel back to a reservoir such as the fuel tank.

Figure 14:
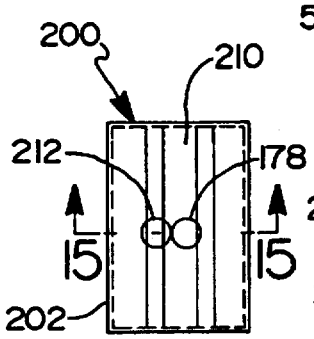
FIG. 14 is a top plan views of the plasma housing structure illustrated in FIG. 13 with the cathodic barrier element positioned within the housing.

Referring now to FIG. 14, a simplified top plan view of the plasma housing assembly 200 is illustrated with the barrier element 210 extending substantially the entire length of the housing 202. The actual physical size of the housing assembly 200 depends upon the spacial parameters within the combustion chamber 156. It is preferred that the housing assembly 200 be positioned centrally with respect to the delivery tube 178 and the electrode 212.

The method of operation of the alternative embodiment internal combustion engine system 150 will now be presented. Referring to FIG. 13, the piston 110 is shown at a top dead center position (T.D.C.) which is approximate to the instant in time when the first burst of electromagnetic energy is delivered from the compliant electromagnetic device 16 through the distributor 14 and directed to the anode 32 and into the housing assembly 200 via the electrode 212. Just prior to the piston reaching top dead center and up until approximately 45° of crankshaft rotation, the fuel control valve 196 is opened and disperses a predetermined quantity of fuel 182 to the combustion chamber 156. This effectively is controlled by the distributor 14 sending a signal 240 to the control valve 196 which essentially meters or controls fuel flow. It will be appreciated that other types of methods may be employed in order to sequence the fuel to the combustion chamber during crankshaft rotation.

Figure 15A:
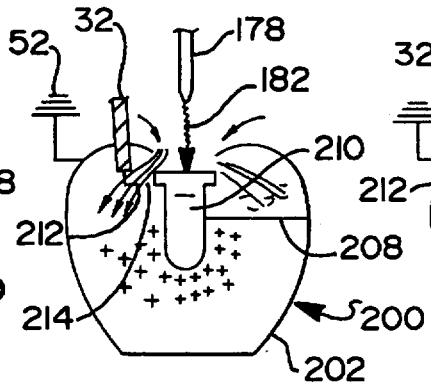
FIG. 15A–15E are cross-sectional view taken along line 15—15 of FIG. 14, illustrating the progressive changes of the field of matter during one four-cycle engine sequence.

FIG. 15A schematically illustrates the presence of electromagnetic energy and fuel within the housing assembly 200 at that instant in time immediately following thermal ignition of the air/fuel mixture. The thermal ignition is caused by the spark across the gap 214. This step essentially causes fragmentation of the fuel particles into positive and negatively charged ions which scatter rapidly throughout the internal combustion chamber, and, especially, within a condensed area of the housing 202.

Figure 15B:
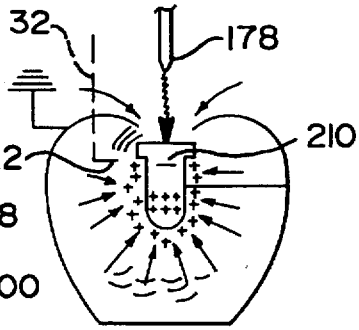

At this point, the barrier element 210 is charged with potential energy like a capacitor and is cathodic thus attracting the fragmented positive ions upon its outer surface. This happens at such a rapid rate that the positive ions tend to bombard the barrier element 210 as illustrated in FIG. 15B. It will be appreciated that the barrier element 210 may have a geometric configuration other than the triangular shape illustrated in FIG. 13, for example, that which is illustrated in FIG. 15B.

Figure 15C:
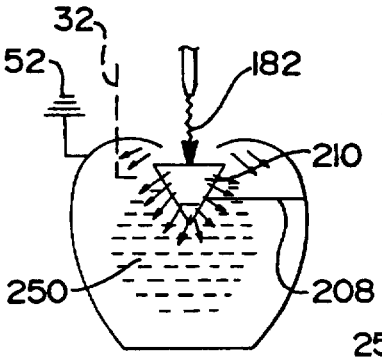

FIG. 15C illustrates schematically the next sequence in which an intense coherent electron avalanche bursts from the continuously charged barrier element 210. At this point the barrier element 210 is acting like a very highly emissive cathode thus creating a very dense cloud 250 of electrons collected away from the surface of the barrier element 210.

Figure 15D:
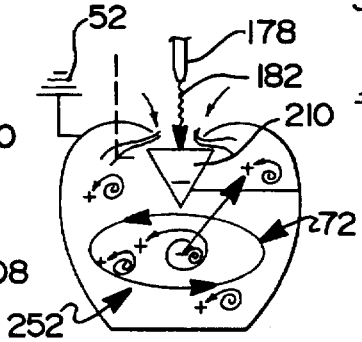

FIG. 15D schematically illustrates the high intensity electron burst dissociating the plasma at that instant in time under high-kinetic energy conditions which establishes an electromagnetic state of field of matter 72. This field of matter 72 essentially is plasma or plasma-like matter that is in rapid motion. At this point in time, an electromagnetic tank circuit 252 is created which is a summed equivalence of the electromagnetic fields at that instant in time represented by FIG. 15C. The electromagnetic tank circuit transfers its energy to fresh matter (i.e. incoming fuel 182) in a normal state until the tank circuit's energy is dissipated meaning that the plasma disappears or that the active period of the electromagnetic pulse has ended. The plasma state essentially is complete by the time the liquid fuel value 196 closes.

Figure 16:
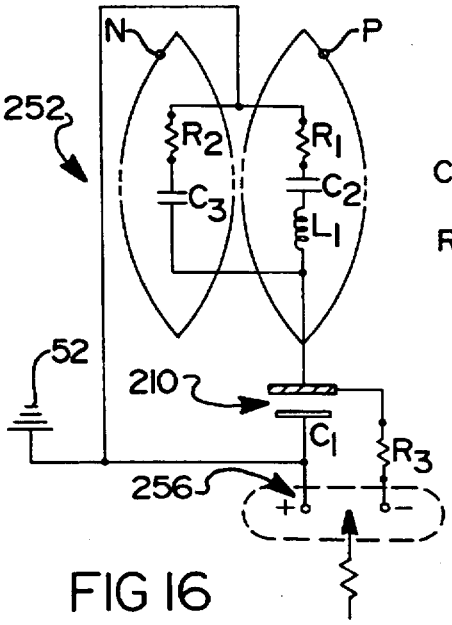
FIG. 16 illustrates schematically an analog circuit existing at the period in time represented by the sequence of FIG. 15D.

FIG. 16 illustrates schematically the analog circuit 252 existing at the instant in time represented by FIG. 15D. Schematically represented within outline "P" is a resistor (R1), capacitor (C2) and inductor (L1) connected in series and representing ion resonances of the plasma in motion. Further illustrated within outline "N" is a resistor (R2) and a capacitor (C3) connected in series which together, the "N" outline is in parallel connection with the "P" outline. The "N" outline represents analog units in adjacent normal fuel mixture which retard or act in opposition to the plasma in motion which, therefore, creates an electromagnetic tank circuit by means of which energy is transferred to the "normal" matter in the "N" outline. The barrier 210 is represented by capacitor (C1) and is momentarily a high-intensity coherent electron emitter. The arrow 254 represents a constant supply of kinetic energy, i.e., fuel 182, that is input to the circuit 252. The element 256 represents the energy charge on the barrier element 210. Resistor (R3) is an analog to illustrate the pulse repetition rate (PRR) where the relaxation time is measured by $T=1/R_3C_1$. It is possible to have a pulse repetition rate of 1000/second and thus, when the period of the pulse equals 200 nanoseconds (which is possible here) it can be seen that the plasma is present 1/5000 of the time with enormous potential energy. This assures that there is complete high intensity combustion of all fuel mixture present between the pulses.

To further assure that there is complete combustion and little if any emission of byproducts, the recirculation system 154 continuously recirculates said byproducts and reenters them into the combustion chamber 156. The pump 172 operates and produces fluids to the delivery valve 178 even when the control value 196 is closed which is primarily during 45° to 720° of crankshaft rotation.

Figure 15E:
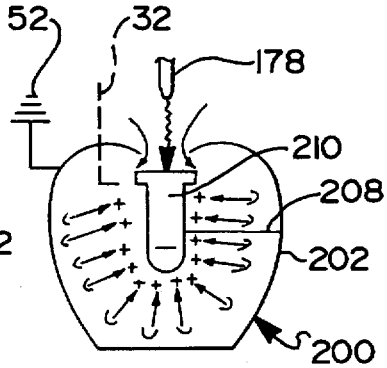

Referring to FIG. 15E, after the original thermal ignition pulse stops, i.e. after the plasma disappears, the normal flame font remains to the extent that a fuel mixture is present in the housing assembly 200. Without the presence of plasma within the housing 204, the positive ions are again free to migrate and collect upon the surface of the charged barrier element 210 until another burst of high-kinetic energy takes place by the anode as illustrated in FIG. 15A. Thus, thermal ignition is only required once as illustrated in FIG. 15A in order for the events illustrated in FIGS. 15A–15E to occur. The charging process is continuous and is evident by the schematic illustrated in FIG. 15E.

Figure 17:
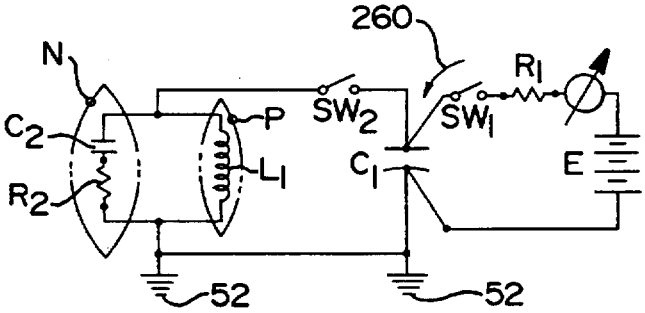
FIG. 17 is a graphic illustration of an electromagnetic tank circuit which occurs at that instant in time represented by the sequence of FIG. 15C.

FIG. 17 further illustrates an electromagnetic tank circuit represented by that sequence illustrated in FIG. 15D whereby the resistor R2 and the capacitor C2 within outline "N" represents normal fuel mixture 182 receiving coherent energization from plasma. The inductor (L1) positioned within outline "P" represents those ion resonances during the life of the pulse. A power source 16 is further connected in series to a variable current component (I), a resistor (R1), and a switch (SW1) to a capacitor (C1). A second switch (SW2) is further connected in series with the capacitor (C1) and the "N" and "P" analog units. The switch (SW2) closes in transition during the sequencing of the FIG. 15C and 15D sequences. The arrow 260 represents kinetic energy or mass in motion that is delivered to the barrier element 210. The barrier element 210 posses potential energy which is charged by the kinetic energy input. The capacitor analog (C1) holds an electrical charge, i.e., excess electrons.

Figure 18:
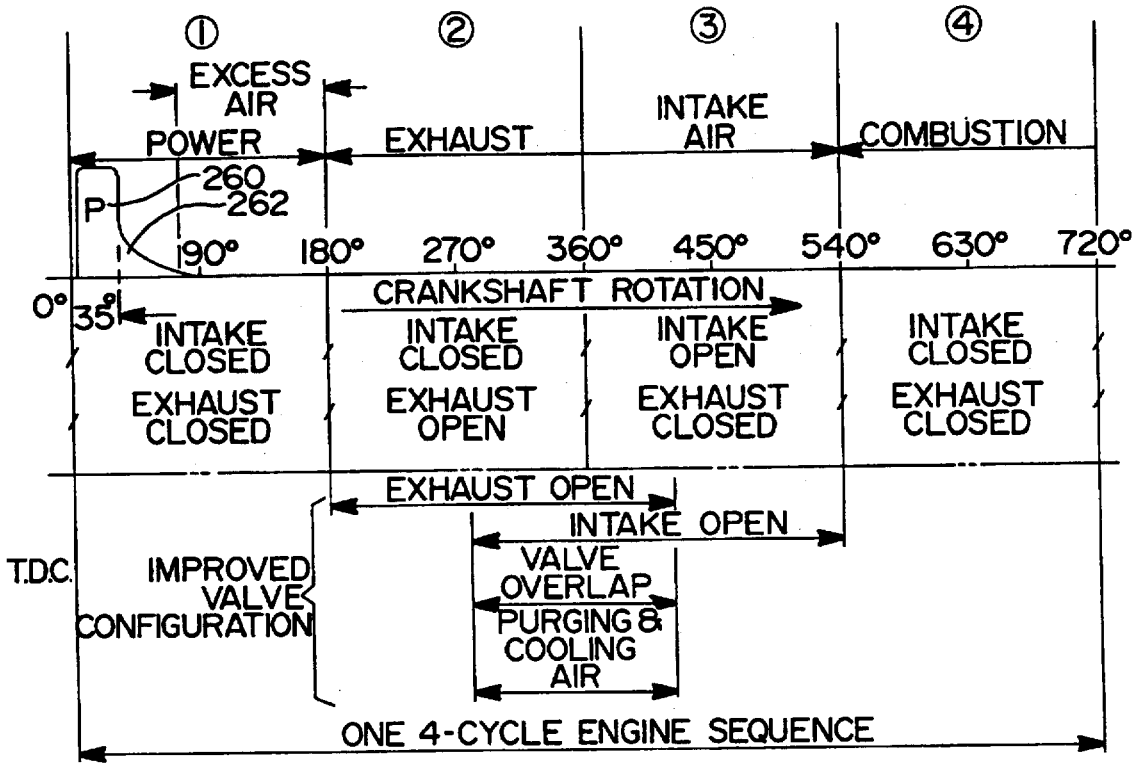
FIG. 18 illustrates graphically a four-cycle sequence and particularly depicts the overlapping of the exhaust and intake valves to enhance purging and cooling.
Figure 19:
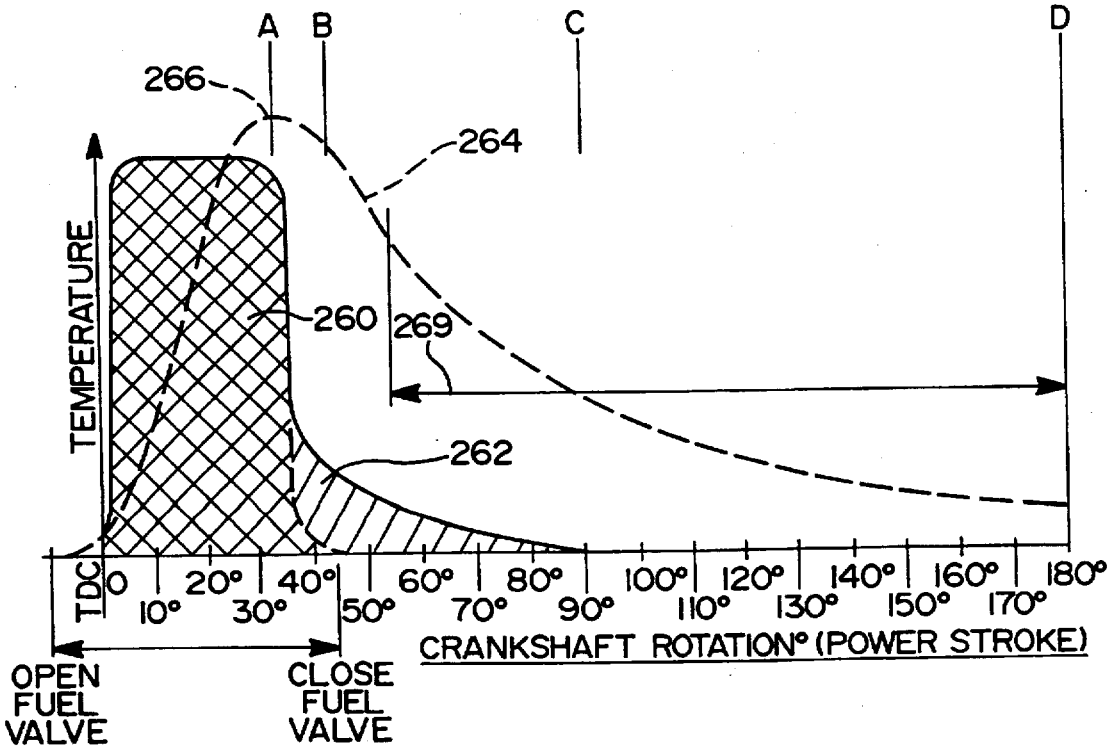
FIG. 19 illustrates graphically an enhancement of the power stroke cycle illustrated in FIG. 17 and further describes the relationship between the power stroke and a) the period of fuel injection, b) the duration of the pulse, c) the duration of the flame, and d) the relationship between temperature and degree of crankshaft rotation during the power stroke.

Referring primarily to FIGS. 13, 18 and 19, the piston 110 is illustrated at various positions relative to top dead center for example, position A (35° past top dead center), position B (45° past top dead center), position C (90° past top dead center), and position D (180° past top dead center). The period of fuel injection by the fuel delivery system 158 is clearly illustrated in FIG. 19 where the fuel valve 196 is opened prior to the piston reaching top dead center and remains wide open preferably until approximately 35° of crankshaft rotation where it may be finally closed at approximately 45° of crankshaft rotation. The shaded area 260 represents energized plasma that is combined with the normal flame font while the area represented by area 262 represents only the normal flame font which is used for residue clean-up. Thus, by sequencing the fuel valve 196 with the degree of crankshaft rotation, there is certain to be sufficient fuel within the combustion chamber 156 during the initial thermal ignition which takes place when the piston is at or near top dead center.

The dashed line 264 schematically illustrates the rise and fall of the temperature within the combustion chamber 156 during one power stroke. Upon thermal ignition of the plasma, the plasma virtually instantaneously appears in full volume and at substantially its full operating peak temperature 266 in the course of nanoseconds. The plasma temperature at this instant in time is many orders of magnitude higher than the effective or average temperature and may be more or less inversely proportional to the period of the pulse to the pulse repetition rate.

The graph line 264 further illustrates that over a range of crankshaft rotation represented by line 269, the combustion chamber temperature is directly effected by the presence of air that may be used for cooling the combustion chamber. Because this unique internal combustion engine system 150 is not sensitive to the air/fuel ratio, it is possible to provide enhanced purging/cooling during the exhaust and intake air stages. This of course adds enhanced overall engine operation. This provides an added benefit over conventional internal combustion engines which generally sequences the opening of the exhaust valve at 180°, the closing of the exhaust valve and the opening of the intake valve at 360°, and the closing of the intake valve at 540° of crankshaft rotation. The present invention allows the exhaust valve 164 to open at approximately 180° and stay open until approximately 415° of crankshaft rotation while the intake valve 162 uniquely opens at approximately 270° and closes at approximately 540° of crankshaft rotation. Thus, a clear overlap area exist between the exhaust valve closing and the intake valve opening which is approximately the time period defined between the 270° and approximately 415° crankshaft angle rotation position.

A state of continuous coherent kinetic energy is established by the low pressure pump 172 continuously circulating a small volume of dense plasma (fuel) in a closed-loop from the combustion chamber and back to the combustion chamber. Thus, a constant source of kinetic energy is disposed upon the housing assembly 200.

It will be appreciated that the alternative embodiment internal combustion engine system 150 may be provided without the fuel heating structure 194, however, said structure is beneficial for enhancing starting under cold start conditions. Even without the heater structure 194, the present invention is an improvement over conventional internal combustion engine systems and including there ignition systems which generally only produce a low magnitude of electrical energy and quantity thereof, with respect to that generated by the present invention. Thus, even without the heater structure 194, the present invention will provide enhanced starting abilities by requiring fewer crankshaft rotations in order for ignition and start-up to occur. Furthermore, because of the unique design of the present invention, the internal combustion engine 150 (and 10) is capable of being put under load conditions upon start-up without stalling. The resulting engine further presents an improvement oven conventional designs by emitting fewer pollutants due to its cleaner burning operation while simultaneously improving mechanical work efficiency (i.e. brake horse power).

The foregoing discussion discloses and describes merely an exemplary embodiment of the present invention. One skilled in the art will readily recognize from such discussion, and from the accompanying drawings and claims, that various changes and modifications can be made therein without departing from the spirit and scope of the invention as defined in the following claims.

What is claimed is:

1. A combustion chamber for an energy generating device comprising:

a cylinder for an energy generating device;

a cylinder head located adjacent said cylinder;

an anode extending through the cylinder head, the anode being operable to carry and deliver a positive charge to the cylinder;

a piston located within the cylinder, the piston being negatively charged and operable to reciprocate relative to the cylinder head; and a varying gap of combustible matter, the gap at least partially defined by the area of space between the anode and the piston.

2. The combustion chamber as claimed in claim 1, wherein said gap includes dielectric material.

3. The combustion chamber as claimed in claim 2, wherein the dielectric material changes as a function of the position of the piston within the cylinder.

4. The combustion chamber as claimed in claim 1, further comprising an impedance characteristic in the gap that changes as a function of the location of the piston.

5. The combustion chamber as claimed in claim 1, further comprising an inductance characteristic in the gap that changes with the positioning of the piston.

6. The combustion chamber as claimed in claim 1, further comprising a step of transformer for delivering the positive charge to the anode.

7. A method of combusting fuel in a combustion chamber having a cylinder, a piston within the cylinder, the method comprising the steps of:

introducing a combustible source to the combustion chamber, the combustible source having a dielectric characteristic;

negatively charging the piston; and introducing a timed positive charge to the combustion chamber when the piston is located to a firing position and when the charge is of sufficient magnitude to overcome the dielectric characteristic of the combustible source.

8. The method of combusting fuel as claimed in claim 7, further comprising the step of increasing voltage to the combustion chamber based upon the location of the piston.

9. The method of combusting fuel as claimed in claim 7, wherein the dielectric characteristic changes relative to the positioning of the piston.

10. The method of combusting fuel as claimed in claim 7, wherein the dielectric characteristic changes relative to a level of non-combusted fuel particles that remain within the combustion chamber after one cycle of revolution.

11. The method of combusting fuel as claimed in claim 7, further comprising the step of storing the positive charge in a capacitor until a sufficient charge is generated to overcome the dielectric characteristic of the combustible material.

12. The method of combusting fuel as claimed in claim 7, wherein the positive charge is generated by an electromagnetic device that is capable of generating a new charge to the combustion chamber every 300 microseconds.

13. The method of combusting fuel as claimed in claim 7, further comprising the step of recirculating non-combusted fuel particles from the combustion chamber and mixing the non-combusted fuel with a fresh supply of fuel.

14. The method of combusting fuel as claimed in claim 7, wherein the step of introducing a timed positive charge includes using a timer device to sequence the delivery of the positive charge to the combustion chamber.

15. A system for combusting fuel in a furnace, the system comprising:

a combustion chamber operable to receive a fuel source and withstand temperatures that are above ambient temperatures;

an anode positioned within the combustion chamber for delivering high energy bursts to the combustion chamber;

an electromagnetic source for repeatedly generating the high energy bursts that are received by the anode; and a negative element positioned within the combustion chamber, a gap of dielectric material positioned between the anode and the negative element.

16. The system for combusting a fuel as claimed in claim 15, further comprising a power source that delivers energy to the electromagnetic source.

17. The system for combusting a fuel as claimed in claim 15, wherein the electromagnetic source includes primary and secondary windings for stepping up its output voltage.

18. The system for combusting a fuel as claimed in claim 15, wherein the electromagnetic source is operable to generate at peak times about 35,000 volts.

19. The system for combusting a fuel as claimed in claim 15, further comprising a recirculation system connected to the combustion chamber for recirculating non-combusted fuel particles.

20. The system for combusting fuel as claimed in claim 19, wherein the recirculation system is comprised of an intake member exposed to the combustion chamber, a pump connected to the intake member for increasing the pressure of the non-combusted fuel particles, and an outlet member connected to a high pressure side of the pump.

* * * * *

UNITED STATES PATENT AND TRADEMARK OFFICE

CERTIFICATE OF CORRECTION

PATENT NO. : 5,711,283

DATED : January 27, 1998

INVENTOR(S) : Vernon A. Trigger

It is certified that error appears in the above-identified patent and that said Letters Patent is hereby corrected as shown below:

The Abstract, in its entirety, beginning and ending with the following words "An internal combustion engine system . . . The resulting internal combustion engine system has improved working efficiencies as well as a reduction in the emissions by the engine"
(including all words in between) should be replaced with the following:

--A system and method for combusting fuel in an energy generating device includes a combustion chamber that is operable to receive fuel. An anode located approximate to the combustion chamber delivers high intense short bursts of electrical energy through the combustion chamber and ignites the fuel at predetermined intervals. An electromagnetic device repeatedly generates the high energy bursts that are delivered to the anode. A negatively charged element is spaced apart from the anode to create a gap of dielectric material within the combustion chamber. Improved working efficiencies are realized for a system that can be used in furnaces or other devices that combust fuels.--

Column 4, Line 65, delete "FIG." and insert --FIGS.--
Column 4, Line 65, delete "view" and insert --views--

UNITED STATES PATENT AND TRADEMARK OFFICE

CERTIFICATE OF CORRECTION

PATENT NO. : 5,711,283

DATED : January 27, 1998

INVENTOR(S) : Vernon A. Trigger

It is certified that error appears in the above-identified patent and that said Letters Patent is hereby corrected as shown below:

Column 4, line 67, delete"views" and insert- view--

Column 20, Line 48, delete "oven" and insert --over--

Signed and Sealed this

First Day of September, 1998

Bruce Lehman

*Attest:*

BRUCE LEHMAN

*Attesting Officer*

*Commissioner of Patents and Trademarks*